US011738901B1

(12) United States Patent
Pishahang et al.

(10) Patent No.: US 11,738,901 B1
(45) Date of Patent: Aug. 29, 2023

(54) RETRACTABLE SCROLLABLE LABELS FOR APPLYING TO AN OBJECT

(71) Applicants: Mehdi Pishahang, Waltham, MA (US); Media Sehatzadeh, Waltham, MA (US)

(72) Inventors: Mehdi Pishahang, Waltham, MA (US); Media Sehatzadeh, Waltham, MA (US)

( * ) Notice: Subject to any disclaimer, the term of this patent is extended or adjusted under 35 U.S.C. 154(b) by 0 days.

(21) Appl. No.: 17/837,753

(22) Filed: Jun. 10, 2022

Related U.S. Application Data

(60) Provisional application No. 63/220,117, filed on Jul. 9, 2021.

(51) Int. Cl.
*B65C 9/26* (2006.01)
*B65C 1/04* (2006.01)
*B65C 9/08* (2006.01)

(52) U.S. Cl.
CPC ..... *B65C 9/26* (2013.01); *B65C 1/04* (2013.01); *B65C 9/08* (2013.01)

(58) Field of Classification Search
CPC ..... G09F 3/0289; B65C 9/26
See application file for complete search history.

(56) References Cited

U.S. PATENT DOCUMENTS 480,430 A * 8/1892 Koch ..... G09B 29/06 242/385.4
490,722 A 1/1893 Pugh
596,873 A 1/1898 Guy
1,049,275 A 12/1912 Bunt
1,561,725 A * 11/1925 Kerley ..... B43K 29/12 40/334
2,041,334 A * 5/1936 Hage ..... A45B 3/00 40/317
2,334,083 A 11/1943 Greenwald
5,359,797 A 11/1994 Williamson
5,798,861 A 8/1998 Doat
6,125,563 A 10/2000 Girerd
6,779,537 B1 * 8/2004 Miller ..... E04H 15/001 135/117
8,070,660 B2 12/2011 Seidel
8,104,202 B2 1/2012 Alipour
8,356,434 B2 1/2013 Alipour
8,973,755 B2 3/2015 Key
9,280,920 B2 * 3/2016 Meng ..... G09F 3/0335
9,427,524 B2 8/2016 Pommereau
(Continued)

*Primary Examiner* — Philip C Tucker
*Assistant Examiner* — John Blades
(74) *Attorney, Agent, or Firm* — QUICKPATENTS, LLC; Kevin Prince

(57) ABSTRACT

An auxiliary label device for attaching to an object, such as a container having a side wall, includes a label enclosure that includes a longitudinal slot therethrough, a bottom side, and a top side. A rotatable spool fixed within the label enclosure is fixed with a first end of a label that traverses the slot of the label enclosure. A spring connected between the label enclosure and the spool urges the spool to wind the label around the spool in a coiled configuration. A second opposing end of the label is attached to the container, and with the spool and label under tension of the spring to urge the label around the spool, the label enclosure is urged to contact the container. The label thereafter is unwound from the spool in an extended configuration for viewing when the label enclosure is manually grasped and pulled away from the container.

20 Claims, 5 Drawing Sheets

(56) References Cited

U.S. PATENT DOCUMENTS

| | | | | |
|---|---|---|---|---|
| 10,439,154 | B2 | 10/2019 | Kim | |
| 10,699,601 | B2 * | 6/2020 | Lacy | B42D 15/022 |
| 10,847,268 | B1 | 11/2020 | Burnett | |
| 10,960,155 | B2 | 3/2021 | Edwards | |
| 2004/0045856 | A1 | 3/2004 | Rhoades | |
| 2007/0031619 | A1 | 2/2007 | Mirabell | |
| 2009/0139126 | A1 * | 6/2009 | Alipour | B65D 85/00 40/642.02 |
| 2010/0215876 | A1 | 8/2010 | Seidl | |
| 2013/0006188 | A1 * | 1/2013 | Pommereau | G09F 3/0295 604/189 |

* cited by examiner

RETRACTABLE SCROLLABLE LABELS FOR APPLYING TO AN OBJECT

CROSS-REFERENCE TO RELATED APPLICATIONS

This application claims the benefit of U.S. Provisional Patent Application 63/220,117, filed on Jul. 9, 2021, and is incorporated herein by reference.

STATEMENT REGARDING FEDERALLY SPONSORED RESEARCH AND DEVELOPMENT

Not Applicable.

FIELD OF THE INVENTION

This invention relates to labels, and more particularly to a retractable auxiliary label device.

BACKGROUND

Objects such as containers for items such as medicine, dietary supplements, and food have only a limited amount of surface area onto which an informational label can be applied. Retailers prefer smaller containers to increase the number of products that can be stored on a retail display, yet often such containers have an insufficient surface area upon which to advertise or provide information about the product that the container holds.

Accordingly, there is a need for a device that can provide additional information about an object such as a container, and product contained within it, yet that is compact and does not greatly increase the footprint of the container on a retail display shelf. Such a needed invention would provide ample additional area on which to print information or advertising, and yet would collapse down to a compact size that does not reduce the amount of product that can be displayed, particularly with cylindrical containers. Such a needed device could be applied to the container after manufacturing, and only if desired, providing options to the retailer and/or manufacturer. The present invention accomplishes these objectives.

SUMMARY OF THE INVENTION

The present device is an auxiliary label device for attaching to an object such as a container that has a surface or side wall. Such a container may be a medicine bottle, a health supplement container, a food container, or the like. The object may be an object other than a container where auxiliary information is helpful, such as on retail display racks, museum exhibits, or the like.

A label enclosure has an enclosure wall that includes a transverse slot therethrough, a bottom side, and a top side. Together, the enclosure wall, the bottom side, and the top side all define an internal volume within the label enclosure. The label enclosure has a longitudinal axis. Preferably the top side of the label enclosure includes a removable top cap. Such a top cap may include a protrusion adapted for fitting into the transverse slot of the label enclosure, such that the top cap is inhibited from rotating with respect to the label enclosure.

A label has a first end and a second end. The label is adapted to travel through the transverse slot of the label enclosure. Preferably the label is rectangular, but could also be made in other shapes as desired.

A spool is fixed between the top side and the bottom side of the label enclosure. The spool is adapted for holding the first end of the label. A spring is connected between the label enclosure and the spool. The spring is adapted for urging the spool to wind the label around the spool in a coiled configuration. In some embodiments the spring includes a metallic coil spring.

The second end of the label is adapted for attaching to the surface of the object, preferably with an adhesive strip. Alternately the second end of the label forms a portion of the label that is affixed about the surface of the object, whereby the second end of the label is attached to itself after wrapping around the object. Alternately, the second end of the label may be ultrasonically bonded to the object, or affixed with other means as is known in the art.

In use, the label enclosure under tension of the spring is urged to roll the label around the spool until the label enclosure contacts the surface of the object. The label thereafter is unwound from the spool to exit the transverse slot of the label enclosure in an extended configuration for viewing when the label enclosure is manually grasped and pulled away from the surface of the object.

In some embodiments, an outside surface of the enclosure wall of the label enclosure includes ridges for facilitating grasping of the label enclosure. The outside surface of the enclosure wall of the label enclosure may also include indicia for instructing a user to pull the label enclosure away from the object to view the label. Preferably the spool further includes a ratcheting mechanism that has two opposing sawtooth plates that, when in mutual contact, are able to rotate in one direction with respect to each other, but are not able to rotate in an opposite direction with respect to each other. As such the label is only urged into the coiled configuration when the two sawtooth plates are mutually apart or separated.

In such an embodiment, preferably an actuator is included that, when actuated, separates the two sawtooth plates to allow the spring to retract the label into the coiled configuration with the label enclosure contacting the object. As such, when the label enclosure is pulled away from the object and into the extended configuration, the label remains in the extended configuration until the actuator is actuated to separate the two sawtooth plates, the spring thereafter causing the label to retract into the coiled configuration as the label enclosure is manually brought into contact with the surface of the object.

Alternately, the actuator may be actuated to bring the two sawtooth plates into mutual contact, wherein when the label enclosure is pulled away from the object and into the extended configuration, the label remains in the extended configuration only while the actuator is actuated. In such an embodiment, releasing the actuator separates the two sawtooth plates, the spring thereafter causing the label to retract into the coiled configuration as the label enclosure is brought into contact with the surface of the object.

The present invention is a device that can provide additional information about the product within an object such as the container, yet is compact and does not greatly increase the footprint of the object on a retail display shelf. The present device provides ample additional area on which to print information or advertising, and yet collapses down to a compact size that does not reduce the amount of product that can be displayed, particularly with cylindrical containers. The present invention can be applied to the surface of the object after manufacturing, and only if desired, providing options to the retailer and/or manufacturer. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
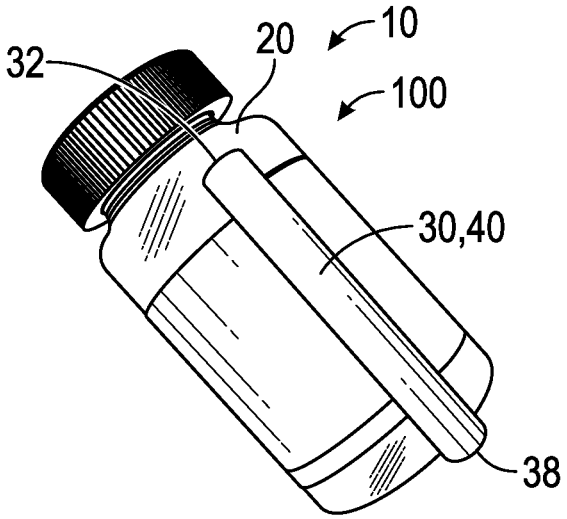
FIG. 1 is a perspective view of the invention, illustrated in a coiled configuration.
Figure 2:
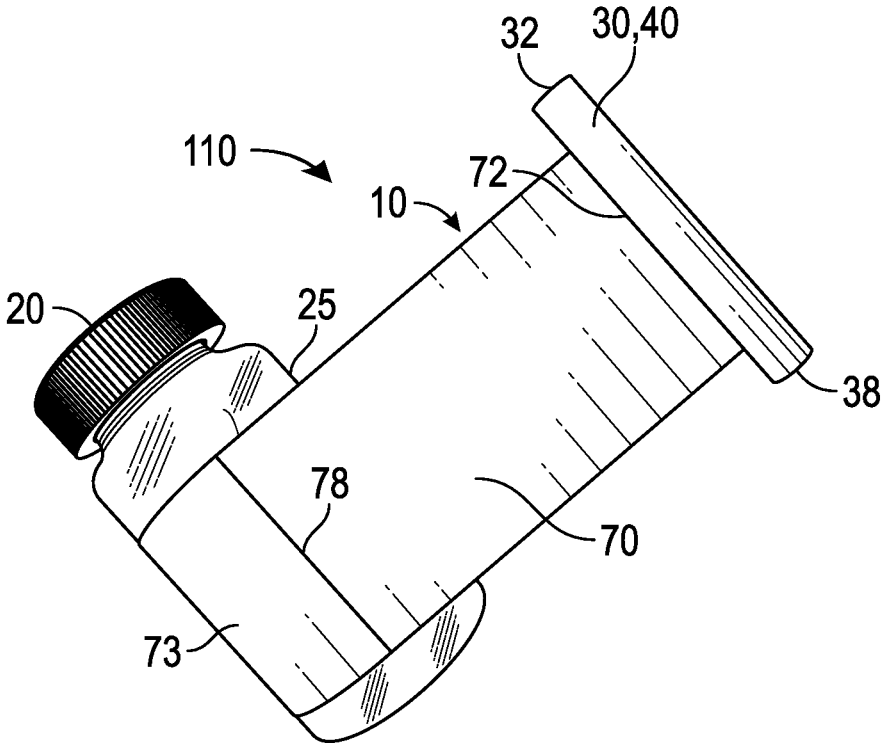
FIG. 2 is a perspective view thereof, illustrated in an extended configuration.
Figure 3:
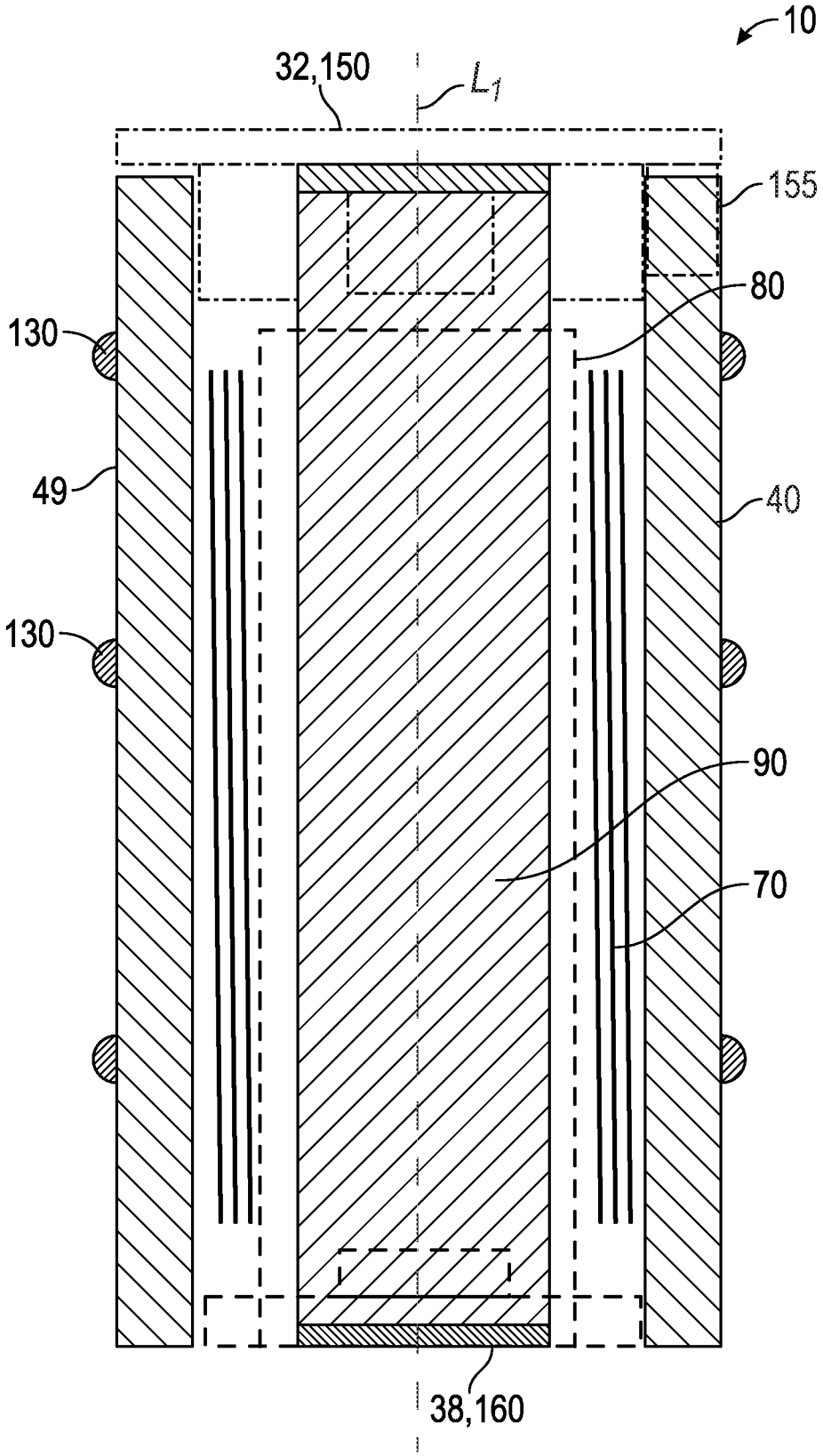
FIG. 3 is a cross-sectional view through a diameter of the invention, illustrated in the coiled configuration.
Figure 5:
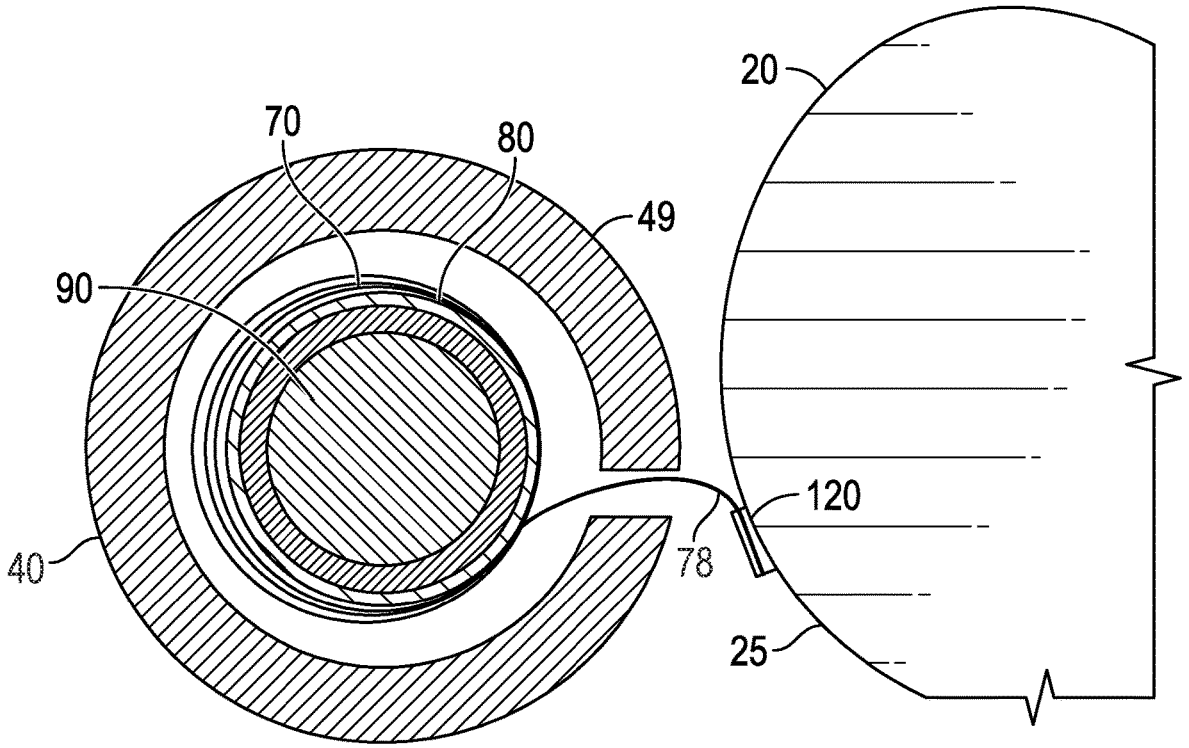
FIG. 5 is a bottom plan view of the invention, illustrated as attached with a container.

FIGS. 1-3 illustrate an auxiliary label device 10 for attaching to a surface of an object 20 that has a side wall 25 (FIG. 5), such as a container 20 that may be a medicine bottle, a health supplement container, a food container, a non-container structure, or the like.

Figure 4:
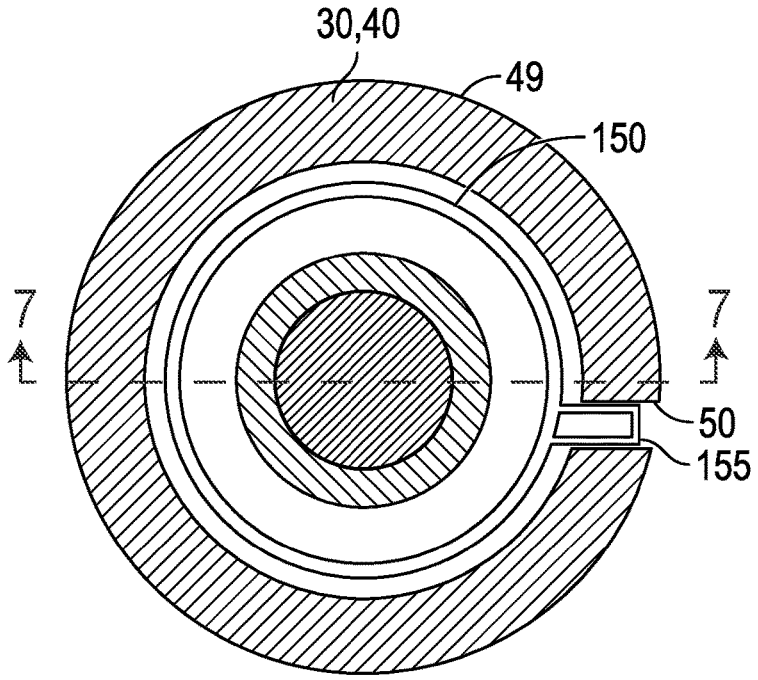
FIG. 4 is a top plan view of the invention, illustrated in the coiled configuration.

A label enclosure 30 has an enclosure wall 40 that includes a transverse slot 50 therethrough, a bottom side 38, and a top side 32. Together, the enclosure wall 40, the bottom side 38, and the top side 32 all define an internal volume 60 within the label enclosure 30. The label enclosure 30 has a longitudinal axis $L_1$. Preferably the top side 32 of the label enclosure 30 includes a removable top cap 150 (FIGS. 3 and 4). Such a top cap 150 may include a protrusion 155 adapted for fitting into the transverse slot 50 of the label enclosure 30, such that the top cap 150 is inhibited from rotating with respect to the label enclosure 30. The removable top cap 150 may engage the label enclosure 30 with a friction fit, but in some embodiments the top cap 150 is adhered or ultrasonically bonded to the label enclosure 30 and not removable.

Similarly, the bottom side 38 of the label enclosure 30 may include a removable bottom cap 160 that also includes one of the protrusions 155 that fits into the traverse slot 50 of the label enclosure 30 for inhibiting the bottom cap 160 from rotating with respect to the label enclosure 30. The removable bottom cap 160 is preferably engaged with the label enclosure 30 with a friction fit, but may also be permanently fixed with adhesive or ultrasonic bonding in some embodiments. In some embodiments the bottom cap 160 does not include the protrusion 155 and is free to rotate with respect to the label enclosure 30. Preferably the label enclosure 30 is made from an injection molded plastic, extruded plastic, cardboard or other paper-based materials, or the like, and is an elongated truncated cylinder or oval cylinder.

A label 70 has a first end 72 and a second end 78. The label 70 is adapted to travel through the transverse slot 50 of the label enclosure 30. Preferably the label 70 is rectangular, but could also be made in other shapes as desired.

Figure 6:
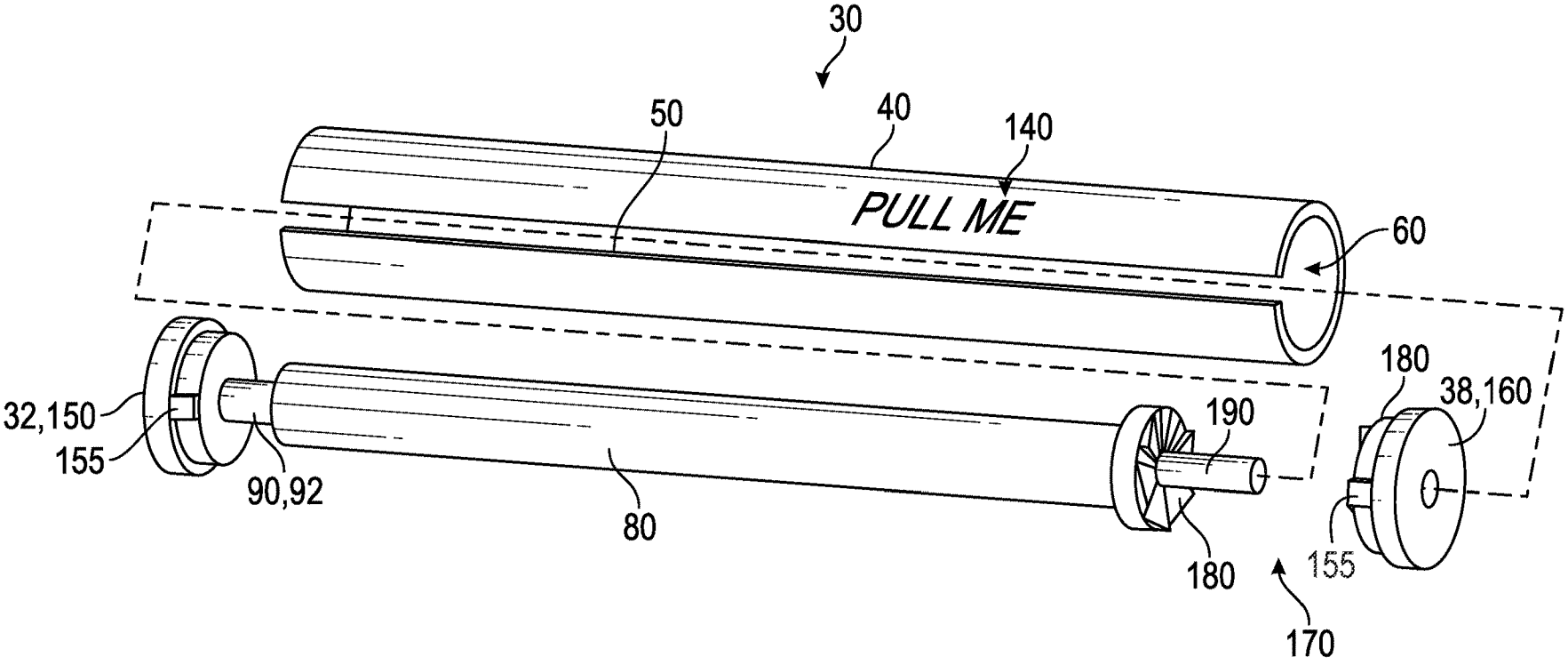
FIG. 6 is an exploded view of one embodiment of the invention.

A spool 80 is fixed between the top side 32 and the bottom side 38 of the label enclosure 30 and is contained within the internal volume 60. The spool 80 is adapted for holding the first end 72 of the label 70, such as by adhesive, a clamp, or other attachment means. A spring 90 is connected between the label enclosure 30 and the spool 80. The spring 90 is adapted for urging the spool 80 to wind the label 70 around the spool 80 in a coiled configuration 100. In some embodiments the spring 90 includes a metallic coil spring 92 (FIG. 6). In other embodiments, the spring 90 includes an elastomeric material, or a foam material.

The second end 78 of the label 70 is adapted for attaching to the surface 25 of an object 20, preferably with an adhesive strip 120. Alternately the second end 78 of the label 70 forms a portion 73 of the label 70 that is affixed about the object 20, whereby the second end 78 of the label 70 is attached to the label 70 after wrapping around the object 20. Alternately, the second end 78 of the label may be ultrasonically bonded to the container 20, or affixed with other means as is known in the art.

In use, the label enclosure 30 under tension of the spring 90 is urged to roll the label 70 around the spool 80 until the label enclosure 30 contacts the container 20. The label 70 thereafter is unwound from the spool 80 to exit the transverse slot 50 of the label enclosure 30 in an extended configuration 110 for viewing when the label enclosure 30 is manually grasped and pulled away from the container 20. The label 70 is loaded into the label enclosure 30 by first rotating the spool 80 to apply tension to the spool 80 from the spring 90, attaching the first end 72 of the label 70 to the spool 80, and then releasing the label 70 into the label enclosure 30 as the spool 80 winds the label 70 into the coiled configuration 100. The spool 80 may be rotated by removing the top cap 150 and then applying rotational force to the spool 80, such as with a power drill or other rotational means.

In some embodiments, an outside surface 49 (FIG. 3) of the enclosure wall 40 of the label enclosure 30 includes ridges 130 for facilitating grasping of the label enclosure 30. The outside surface 49 of the enclosure wall 40 of the label enclosure 30 may further include indicia 140 for instructing a user to pull the label enclosure 30 away from the container 20 to view the label 70.

Preferably the spool 80 further includes a ratcheting mechanism 170 that has two opposing sawtooth plates 180 that, when in mutual contact, are able to rotate in one direction with respect to each other, but are not able to rotate in an opposite direction with respect to each other. As such the label 70 is only urged into the coiled configuration 100 when the two sawtooth plates 180 are mutually apart or separated. One of the sawtooth plates 180 is rotationally fixed with the spool 80 while the other sawtooth plate 180 is rotationally fixed with the label enclosure 30. A plate spring (not shown) may urge the plates 180 together in some embodiments.

Figure 7:
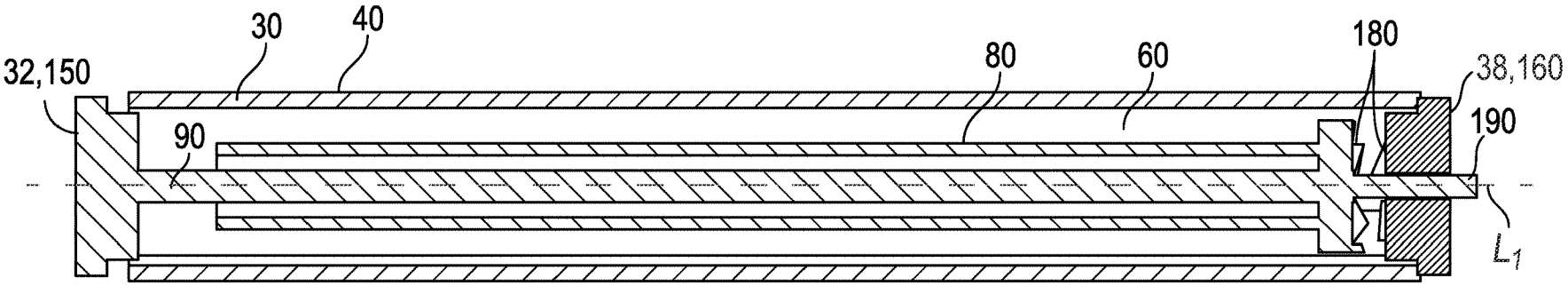
FIG. 7 is a cross-section of the invention, taken along lines 7-7 of FIG. 4.

In such an embodiment, preferably an actuator 190 is included that, when actuated, separates the two sawtooth plates 180 to allow the spring 90 to retract the label 70 into the coiled configuration 100 with the label enclosure 30 contacting the container 20. As such, when the label enclosure 30 is pulled away from the container 20 and into the extended configuration 110, the label 70 remains in the extended configuration 110 with the sawtooth plates 180 pressed together with the plate spring until the actuator 190 is actuated to separate the two sawtooth plates 180, the spring 90 thereafter urging the label 70 to retract into the coiled configuration 100 as the label enclosure 30 is manually brought into contact with the container 20. Preferably the ratcheting mechanism 170 is proximate the bottom side 38 of the label enclosure 30, with the actuator 190 projecting through the bottom cap 160 that is fixed with one of the sawtooth plates 180, the actuator 190 terminating at the other sawtooth plate 180 so that pressing the actuator 190 up towards the label enclosure 30 separates the two sawtooth plates 180 (FIGS. 6 and 7).

In alternate embodiments, the plate spring urges the plates 180 apart, and the actuator 190 may be actuated to bring the two sawtooth plates 180 into mutual contact, wherein when the label enclosure 30 is pulled away from the container 20 and into the extended configuration 110, the label 70 remains in the extended configuration 110 only while the actuator 190 is actuated. In such an embodiment, releasing the actuator 190 allows the plate spring to urge the two sawtooth plates 180 away from each other, the spring 90 thereafter urging the label 70 to retract into the coiled configuration 100 as the label enclosure 30 is brought into contact with the container 20.

In some embodiments, extending the label 70 a first predetermined distance out of the label enclosure 30 actuates the actuator 190 to allow retraction of the label 70 into the label enclosure 30 with the label enclosure 30 contacting the container 20. In some such embodiments, extending the label 70 a second predetermined distance out of the label enclosure 30 brings the two sawtooth plates 180 into mutual contact, the first predetermined distance being greater than the second predetermined distance. As such, once the label 70 is pulled at least the second predetermined distance, the label enclosure 30 can be released and the label 70 will maintain its extended configuration 110. Then pulling the label enclosure 30 a bit more until the first predetermined distance is reached, the actuator 190 separates the two sawtooth plates 180 so that the label 70 is retracted until the label enclosure 30 again contacts the container 20. In some embodiments, the top cap 150 is utilized as the actuator 190, the top cap 150 being able to be pressed down to actuate the actuator 190.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An auxiliary label device for attaching to an outside surface of a container, the auxiliary label device comprising:

a label enclosure having an enclosure wall with a transverse slot therethrough, a bottom side, and a top side, the enclosure wall, bottom side, and top side all defining an internal volume within the label enclosure, the top side being movable with respect to the enclosure wall, the label enclosure further having a longitudinal axis;

a label having a first end and a second end, the label adapted to travel through the transverse slot of the label enclosure;

a spool fixed between the top side and the bottom side of the label enclosure, the spool adapted for holding the first end of the label;

a spring connected between the label enclosure and the spool and adapted for urging the spool to wind the label around the spool in a coiled configuration;

the spool further including a ratcheting mechanism having two opposing sawtooth plates that, when in mutual contact are able to rotate in one direction with respect to each other, but are not able to rotate in an opposite direction with respect to each other, whereby the label is only urged into the coiled configuration when the two sawtooth plates are apart, the longitudinal axis of the label enclosure extending through each of the two sawtooth plates such that the two sawtooth plates are coaxial;

an actuator projecting through one of the two sawtooth plates of the ratcheting mechanism and through the bottom side of the label enclosure, the actuator terminating at the other of the two sawtooth plates, wherein pushing the actuator upwardly moves the top side of the label enclosure upwardly with respect to the enclosure wall and separates the two sawtooth plates to allow the spring to retract the label into the coiled configuration, and wherein pushing the top side of the label enclosure downwardly with respect to the enclosure wall moves the actuator downwardly and brings the two sawtooth plates into mutual contact to prevent the spring from retracting the label into the coiled configuration;

the second end of the label adapted for attaching to the outside surface of the container such that, when the second end of the label is attached to the outside surface of the container, the label enclosure is disposed outside of the container and is movable with respect to at least the outside surface of the container;

whereby the label enclosure under tension of the spring is urged to roll the label around the spool until the label enclosure contacts the outside surface of the container, the label thereafter being unwound from the spool to exit the transverse slot of the label enclosure in an extended configuration for viewing when the label enclosure is manually grasped and pulled away from the outside surface of the container.

2. The auxiliary label device of claim 1 wherein the second end of the label is adapted for attaching to the outside surface of the container with an adhesive strip.

3. The auxiliary label device of claim 1 wherein the second end of the label forms a portion of the label that is affixed about the container.

4. The auxiliary label device of claim 1 wherein an outside surface of the enclosure wall of the label enclosure includes ridges for facilitating grasping of the label enclosure.

5. The auxiliary label device of claim 1 wherein an outside surface of the enclosure wall of the label enclosure includes indicia for instructing a user to pull the label enclosure away from the outside surface of the container to view the label.

6. The auxiliary label device of claim 1 wherein the top side of the label enclosure is a removable top cap.

7. The auxiliary label device of claim 6 wherein the top cap includes a protrusion adapted for fitting into the transverse slot of the label enclosure, whereby the top cap is inhibited from rotating with respect to the label enclosure.

8. The auxiliary label device of claim 1 wherein the bottom side of the label enclosure is a removable bottom cap.

9. The auxiliary label device of claim 8 wherein the bottom cap includes a protrusion adapted for fitting into the transverse slot of the label enclosure, whereby the bottom cap is inhibited from rotating with respect to the label enclosure.

10. The auxiliary label device of claim 1 wherein the spring is a metallic coil spring.

11. The auxiliary label device of claim 1 wherein the spring is an elastomeric material or a foam material.

12. An auxiliary label device for attaching to a surface of an object, the auxiliary label device comprising:

a label enclosure having an enclosure wall with a transverse slot therethrough, a bottom side, and a top side, the enclosure wall, bottom side, and top side all defining an internal volume within the label enclosure, the top side being movable with respect to the enclosure wall, the label enclosure further having a longitudinal axis;

a label having a first end and a second end, the label adapted to travel through the transverse slot of the label enclosure;

a spool fixed between the top side and the bottom side of the label enclosure, the spool adapted for holding the first end of the label;

a spring connected between the label enclosure and the spool and adapted for urging the spool to wind the label around the spool in a coiled configuration;

the spool further including a ratcheting mechanism having two opposing sawtooth plates that, when in mutual contact are able to rotate in one direction with respect to each other, but are not able to rotate in an opposite direction with respect to each other, whereby the label is only urged into the coiled configuration when the two sawtooth plates are apart, the longitudinal axis of the label enclosure extending through each of the two sawtooth plates such that the two sawtooth plates are coaxial;

an actuator projecting through one of the two sawtooth plates of the ratcheting mechanism and through the bottom side of the label enclosure, the actuator terminating at the other of the two sawtooth plates, wherein pushing the actuator upwardly moves the top side of the label enclosure upwardly with respect to the enclosure wall and separates the two sawtooth plates to allow the spring to retract the label into the coiled configuration, and wherein pushing the top side of the label enclosure downwardly with respect to the enclosure wall moves the actuator downwardly and brings the two sawtooth plates into mutual contact to prevent the spring from retracting the label into the coiled configuration;

the second end of the label adapted for attaching to the surface of the object;

whereby the label enclosure under tension of the spring is urged to roll the label around the spool until the label enclosure contacts the surface of the object, the label thereafter being unwound from the spool to exit the transverse slot of the label enclosure in an extended configuration for viewing when the label enclosure is manually grasped and pulled away from the object.

13. The auxiliary label device of claim 12 wherein the top side of the label enclosure is a removable top cap.

14. The auxiliary label device of claim 13 wherein the top cap includes a protrusion adapted for fitting into the transverse slot of the label enclosure, whereby the top cap is inhibited from rotating with respect to the label enclosure.

15. The auxiliary label device of claim 12 wherein the bottom side of the label enclosure is a removable bottom cap.

16. The auxiliary label device of claim 15 wherein the bottom cap includes a protrusion adapted for fitting into the transverse slot of the label enclosure, whereby the bottom cap is inhibited from rotating with respect to the label enclosure.

17. The auxiliary label device of claim 12 wherein the second end of the label forms a portion of the label that is affixed about the object.

18. An auxiliary label device for attaching to a surface of an object, the auxiliary label device comprising:

a label enclosure having an enclosure wall with a transverse slot therethrough, a bottom cap, and a top cap, the enclosure wall, bottom cap, and top cap all defining an internal volume within the label enclosure, the top cap being movable with respect to the enclosure wall and including a protrusion adapted for fitting into the transverse slot, whereby the top cap is inhibited from rotating with respect to the label enclosure, the label enclosure further having a longitudinal axis;

a label having a first end and a second end, the label adapted to travel through the transverse slot of the label enclosure;

a spool fixed between the top cap and the bottom cap of the label enclosure, the spool adapted for holding the first end of the label;

a spring connected between the label enclosure and the spool and adapted for urging the spool to wind the label around the spool in a coiled configuration;

the spool further including a ratcheting mechanism having two opposing sawtooth plates that, when in mutual contact are able to rotate in one direction with respect to each other, but are not able to rotate in an opposite direction with respect to each other, whereby the label is only urged into the coiled configuration when the two sawtooth plates are apart, the longitudinal axis of the label enclosure extending through each of the two sawtooth plates such that the two sawtooth plates are coaxial;

an actuator projecting through one of the two sawtooth plates of the ratcheting mechanism and through the bottom cap of the label enclosure, the actuator terminating at the other of the two sawtooth plates, wherein pushing the actuator upwardly moves the top cap of the label enclosure upwardly with respect to the enclosure wall and separates the two sawtooth plates to allow the spring to retract the label into the coiled configuration, and wherein pushing the top cap of the label enclosure downwardly with respect to the enclosure wall moves the actuator downwardly and brings the two sawtooth plates into mutual contact to prevent the spring from retracting the label into the coiled configuration;

the second end of the label adapted for attaching to the surface of the object;

whereby the label enclosure under tension of the spring is urged to roll the label around the spool until the label enclosure contacts the surface of the object, the label thereafter being unwound from the spool to exit the transverse slot of the label enclosure in an extended configuration for viewing when the label enclosure is manually grasped and pulled away from the object.

19. The auxiliary label device of claim 18 wherein the bottom cap is removable and includes a protrusion adapted for fitting into the transverse slot of the label enclosure, whereby the bottom cap is inhibited from rotating with respect to the label enclosure.

20. The auxiliary label device of claim 18 wherein the second end of the label forms a portion of the label that is affixed about the object.

* * * * *